US008851873B2

(12) United States Patent
Yan et al.

(10) Patent No.: US 8,851,873 B2
(45) Date of Patent: Oct. 7, 2014

(54) AUTOMATIC CIRCLE FORMING APPARATUS

(75) Inventors: Ai-Jun Yan, Guang-Dong (CN); Wei Wang, Guang-Dong (CN); Wen-Zhi Xia, Guang-Dong (CN)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 251 days.

(21) Appl. No.: 13/468,346

(22) Filed: May 10, 2012

(65) Prior Publication Data

US 2013/0302461 A1 Nov. 14, 2013

(51) Int. Cl.

| | |
|---|---|
| ***B65H 20/32*** | (2006.01) |
| ***B65H 43/00*** | (2006.01) |
| ***B65H 9/12*** | (2006.01) |

(52) U.S. Cl.

USPC ..... 425/112; 425/135; 425/163; 425/164; 425/184; 425/193; 425/226; 425/230; 425/302.1; 425/388; 264/242; 264/284; 264/285; 264/294; 264/339; 29/402.19; 226/63; 226/67; 226/86

(58) Field of Classification Search

CPC ..... B65H 20/24; B65H 20/32; B65H 9/12; B65H 29/242; B65H 43/00; B65H 57/28

USPC ..... 425/108, 510, 112, 136, 163, 164, 182, 425/184, 185, 186, 193, 226, 230, 231, 232, 425/302.1, 304, 305.1, 323, 388, 135; 29/402.19, 469, 527.1, 566; 226/128, 226/62–63, 67, 86–88

See application file for complete search history.

(56) References Cited

U.S. PATENT DOCUMENTS

| | | | | |
|---|---|---|---|---|
| 3,239,879 | A * | 3/1966 | Resnick | 425/531 |
| 3,254,371 | A * | 6/1966 | Rees | 425/145 |
| 3,410,466 | A * | 11/1968 | Harris et al. | 226/6 |
| 3,608,800 | A * | 9/1971 | Zahradnik et al. | 226/62 |
| 4,976,598 | A * | 12/1990 | Hehl | 164/150.1 |
| 7,008,209 | B2 * | 3/2006 | Iskra et al. | 425/182 |
| 7,611,036 | B2 * | 11/2009 | Yu | 226/188 |
| 8,105,066 | B2 * | 1/2012 | Sperry et al. | 425/185 |
| 8,517,245 | B1 * | 8/2013 | Yan et al. | 228/4.5 |
| 2004/0241267 | A1 * | 12/2004 | Schultz | 425/193 |
| 2008/0174048 | A1 * | 7/2008 | Boyd et al. | 264/328.11 |
| 2011/0045116 | A1 * | 2/2011 | Augustine | 425/302.1 |
| 2011/0045118 | A1 * | 2/2011 | Polk et al. | 425/388 |
| 2012/0104077 | A1 * | 5/2012 | Tian et al. | 228/212 |
| 2013/0328249 | A1 * | 12/2013 | Klausriegler | 264/537 |

* cited by examiner

*Primary Examiner* — Dimple Bodawala
(74) *Attorney, Agent, or Firm* — Cheng-Ju Chiang

(57) ABSTRACT

An automatic circle forming apparatus adapted for automatically forming OPP (O-phenylphenol) plastic circles includes a lower equipment cabinet, a first base plate, a transmitting module, an automatic separating module, an automatic tearing film module, a sucking waste mechanism, a displacement module, an automatic forming module and an upper equipment cabinet. The upper equipment cabinet is positioned on the first base plate for installing the transmitting module, the automatic separating module, the automatic tearing film module, the sucking waste mechanism, the displacement module and the automatic forming module therein. The upper equipment cabinet is equipped with a man-machine control interface which connects with and controls the transmitting module, the automatic separating module, the automatic tearing film module, the sucking waste mechanism, the displacement module and the automatic forming module for automatically forming the OPP plastic circles so as to improve operation efficiency and save a human cost.

10 Claims, 9 Drawing Sheets

AUTOMATIC CIRCLE FORMING APPARATUS

BACKGROUND OF THE INVENTION

1. Field of the Invention

The present invention generally relates to a processing apparatus, and more particularly to an automatic circle forming apparatus.

2. The Related Art

Generally, after a cable is assembled, the cable is ready for being delivered. In order to meet environmental protection request, the cable is always bundled up by a plastic, such as an OPP (O-phenylphenol) plastic film. Before using the OPP plastic film to bundle the cable, the OPP plastic film should be peeled from a release paper and a protecting film should be torn up from a glue portion of the OPP plastic film, and then fold the OPP plastic film to a circle shape according to a packaging standard and adhere a free side of the OPP plastic film to the glue portion of the OPP plastic film to form the OPP plastic circle for bundling the cable. However, the aforesaid packing process is operated manually, and only one OPP plastic circle can be formed during one operation process. It wastes working time that lowers an operation speed and needs more operators that waste a human cost. Thereby, the manual operation way of forming the OPP plastic circle has problems of lower manufacturing efficiency, higher human cost and so on, and fails to meet a mass production request.

SUMMARY OF THE INVENTION

An object of the present invention is to provide an automatic circle forming apparatus adapted for automatically forming OPP plastic circles includes a lower equipment cabinet, a first base plate, a transmitting module, an automatic separating module, an automatic tearing film module, a sucking waste mechanism, a displacement module, an automatic forming module and an upper equipment cabinet. The lower equipment cabinet includes an electric cabinet for installing electric apparatuses therein and arranging wires of the automatic circle forming apparatus. The first base plate is mounted on the lower equipment cabinet. The transmitting module is mounted on one side of the first base plate for locating release papers together with OPP plastic films therein. The automatic separating module is mounted on the first base plate and is located under the transmitting module for separating the release papers from the OPP plastic films. The automatic tearing film module is mounted on the first base plate, and is located above the transmitting module and the automatic separating module for tearing up protecting films adhered to glue portions of the OPP plastic films. The sucking waste mechanism is mounted on the first base plate and is adjacent to the automatic separating module. The sucking waste mechanism is located under the automatic tearing film module for sucking away the protecting films. The displacement module is mounted on the other side of the first base plate for transmitting the OPP plastic films to an automatic forming module. The automatic forming module is mounted on the first base plate, and located between the sucking waste mechanism and the displacement module for looping the OPP plastic films to form the OPP plastic circles and further discharging the OPP plastic circles out of the automatic circle forming apparatus. The upper equipment cabinet is positioned on the first base plate for installing the transmitting module, the automatic separating module, the automatic tearing film module, the sucking waste mechanism, the displacement module and the automatic forming module therein. The upper equipment cabinet is equipped with a man-machine control interface. The man-machine control interface connects with and controls the transmitting module, the automatic separating module, the automatic tearing film module, the sucking waste mechanism, the displacement module and the automatic forming module for automatically forming the OPP plastic circles.

As described above, the man-machine control interface connects with and controls the transmitting module, the automatic separating module, the automatic tearing film module, the sucking waste mechanism, the displacement module and the automatic forming module for realizing a series of continuous operations of automatically transmitting the OPP plastic films, separating the release papers from the OPP plastic films, looping the OPP plastic films and discharging the OPP plastic circles so as to form a plurality of the OPP plastic circles in one time. Thus, the automatic circle forming apparatus improves operation efficiency and decreases the operators to save the human cost. Furthermore, the automatic circle forming apparatus has a fast operation speed and a stable quality to meet a mass production request.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
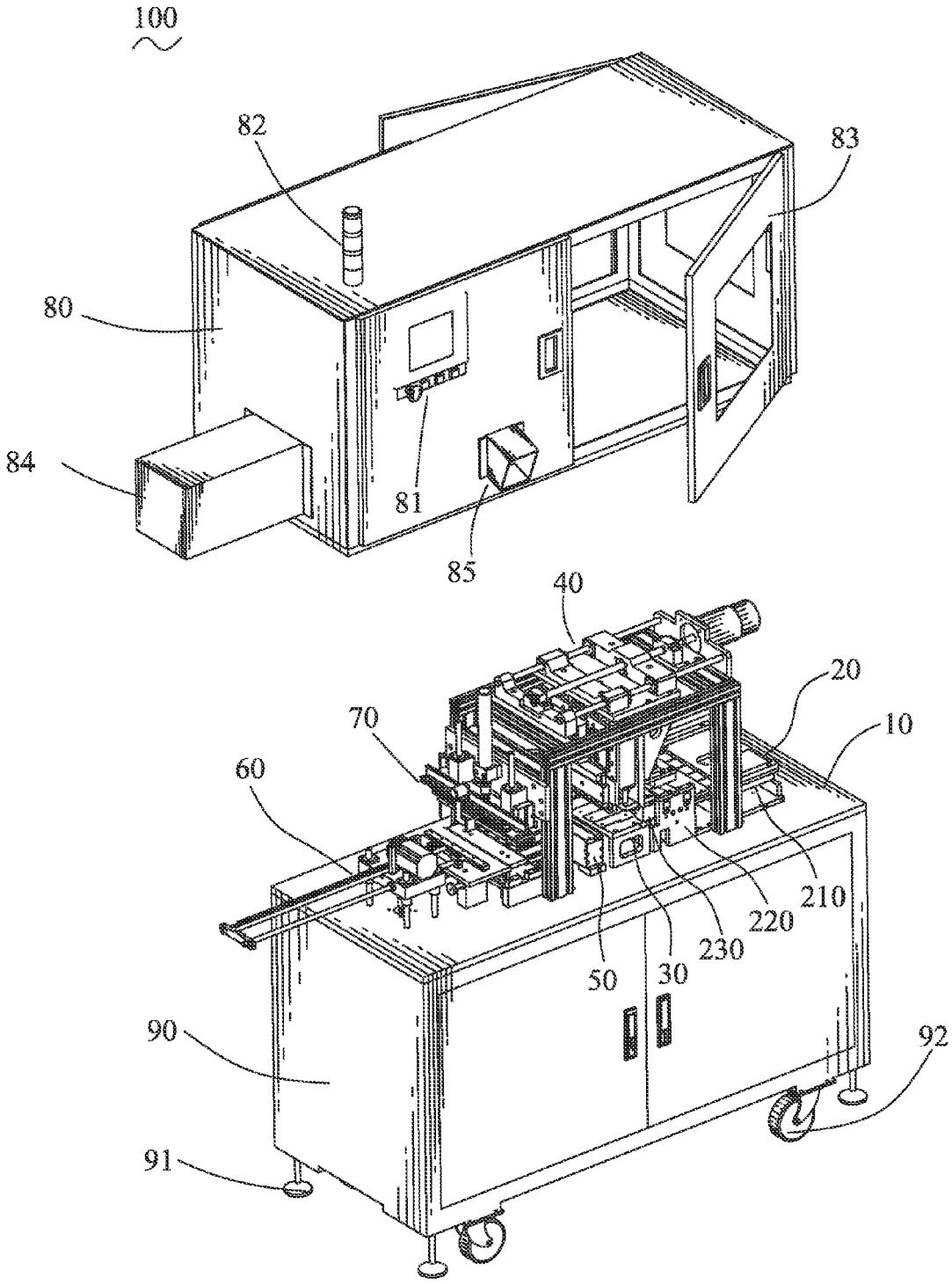
FIG. 1 is a perspective view of an automatic circle forming apparatus in accordance with the present invention.

With reference to FIG. 1, an automatic circle forming apparatus 100 in accordance with the present invention is shown. The automatic circle forming apparatus 100 adapted for automatically forming OPP plastic circles (not shown) includes a lower equipment cabinet 90, a first base plate 10, a transmitting module 20, an automatic separating module 30, an automatic tearing film module 40, a sucking waste mechanism 50, a displacement module 60, an automatic forming module 70 and an upper equipment cabinet 80. The first base plate 10 is mounted on top of the lower equipment cabinet 90, the transmitting module 20, the automatic separating module 30, the automatic tearing film module 40, the sucking waste mechanism 50, the displacement module 60, the automatic forming module 70 are mounted on the first base plate 10, and the upper equipment cabinet 80 is positioned on the first base plate 10 for installing the transmitting module 20, the automatic separating module 30, the automatic tearing film module 40, the sucking waste mechanism 50, the displacement module 60 and the automatic forming module 70 therein. A front of the upper equipment cabinet 80 is equipped with a man-machine control interface 81. The man-machine control interface 81 connects with and controls the transmitting module 20, the automatic separating module 30, the automatic tearing film module 40, the sucking waste mechanism 50, the displacement module 60 and the automatic forming module 70 for automatically forming the OPP plastic circles.

Figure 2:
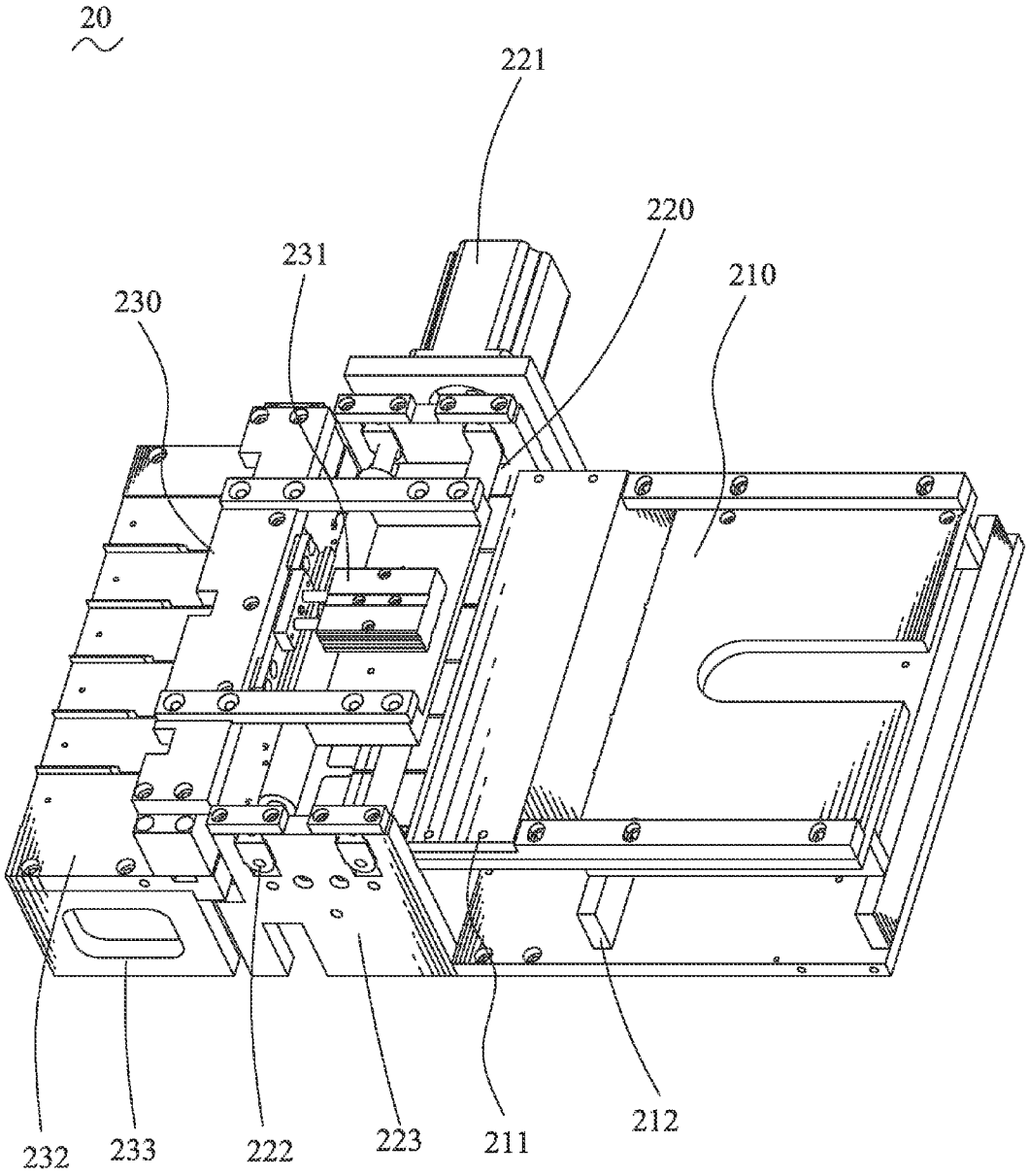
FIG. 2 is a perspective view of a transmitting module of the automatic circle forming apparatus of FIG. 1.

Referring to FIG. 1 and FIG. 2, the transmitting module 20 mounted on one side of the first base plate 10 includes a transmitting platform 210, a central transmitting module 220 and a pressing material module 230. The transmitting platform 210 is located in one side of the transmitting module 20. The transmitting module 20 further includes a platform supporting frame 212 disposed under the transmitting platform 210, and has a transmitting entrance 211 disposed in one side of the transmitting platform 210. One side of the central transmitting module 220 is connected with the one side of the transmitting platform 210 in which the transmitting entrance 211 is disposed. The central transmitting module 220 includes a transmitting motor 221, two pairs of transmitting rollers 222 and two roller supporting frames 223. The two roller supporting frames 223 are located in two opposite sides of the transmitting mechanism 20. The two pairs of the transmitting rollers 222 are mounted between the two roller supporting frames 223, and one pair of the transmitting rollers 222 are located above the other pair of the transmitting rollers 222. The transmitting motor 221 is mounted to an outer side of one of the roller supporting frames 223 to connect with the transmitting rollers 222 for driving the transmitting rollers 222 to bring along release papers together with OPP plastic films into the transmitting module 20. The pressing material module 230 is disposed to the other side of the central transmitting module 220. The pressing material module 230 includes a first supporting frame 233, a pressing plate 232 and a pressing cylinder 231. The pressing plate 232 is mounted on the first supporting frame 233 and the pressing cylinder 231 is mounted on the pressing plate 232. The release papers together with the OPP plastic films are pushed into the transmitting module 20 through the transmitting platform 210, and pass through the central transmitting module 220. The pressing cylinder 231 pushes sideward to drive the release papers together with the OPP plastic films to be located in the pressing material module 230 of the transmitting module 20.

Figure 3:
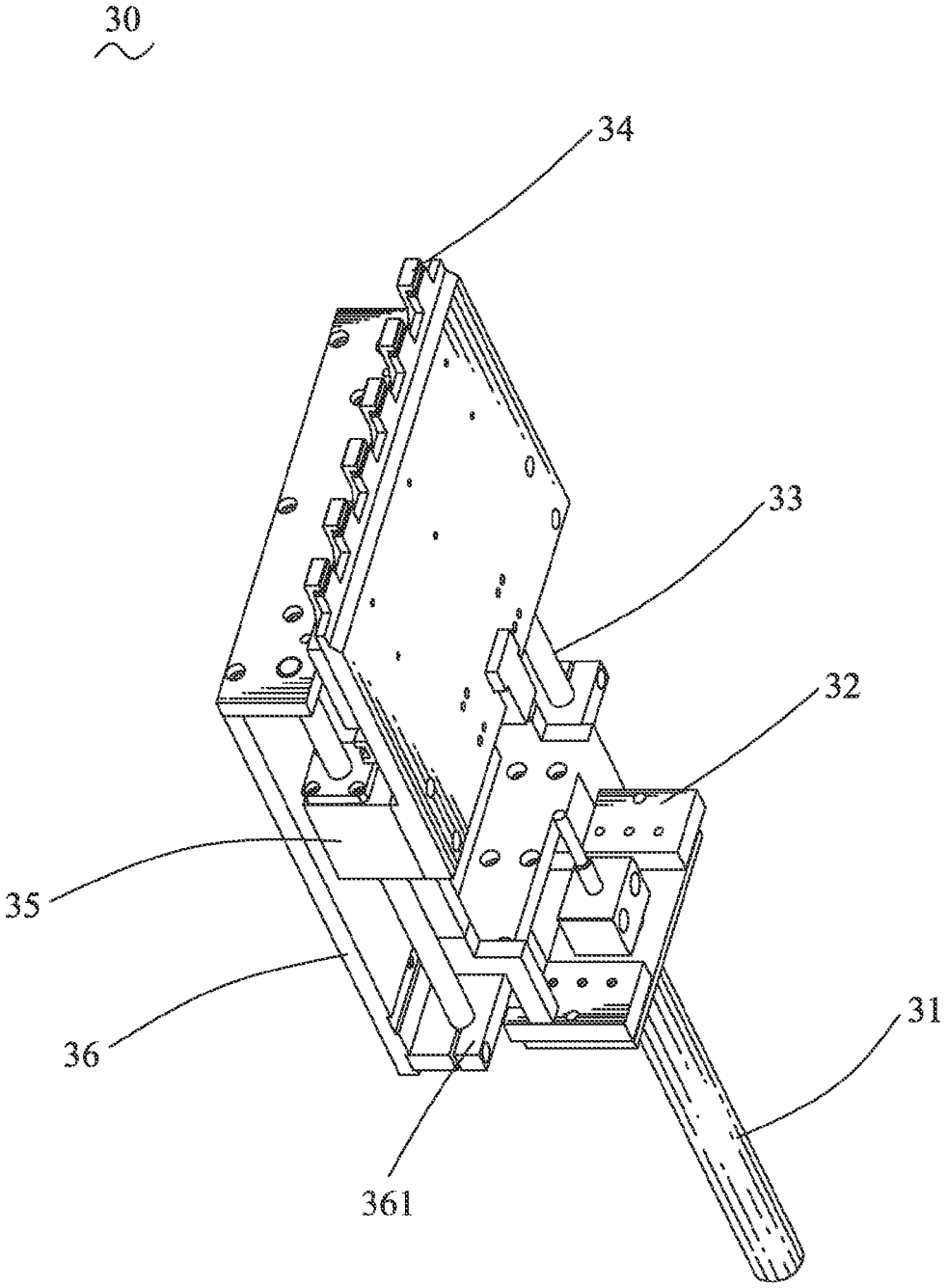
FIG. 3 is a perspective view of an automatic separating module of the automatic circle forming apparatus of FIG. 1.

Referring to FIG. 1 and FIG. 3, the automatic separating module 30 mounted on the first base plate 10 and located under the transmitting module 20 includes a second base plate 36, two first guiding rods 33, a first sliding block 35, a cylinder fastening shelf 32 and a pulling paper cylinder 31. Two opposite ends of the second base plate 36 extend in parallel towards a same direction to form two supporting plates 361. The two guiding rods 33 pass through two opposite sides of the first sliding block 35. The two guiding rods 33 together with the first sliding block 35 are mounted between the two supporting plates 361 and spaced from each other. A top of the first sliding block 35 defines a plurality of clamping claws 34. In this embodiment, the top of the first sliding block 35 defines six clamping claws 34 for clamping the release papers. The cylinder fastening shelf 32 is mounted to the second base plate 36 and located between the two first guiding rods 33. The pulling paper cylinder 31 is connected with a bottom of the cylinder fastening shelf 32. The clamping claws 34 clamp the release papers to pull downward under a drive of the pulling paper cylinder 31 for separating the release papers from the OPP plastic films.

Figure 4:
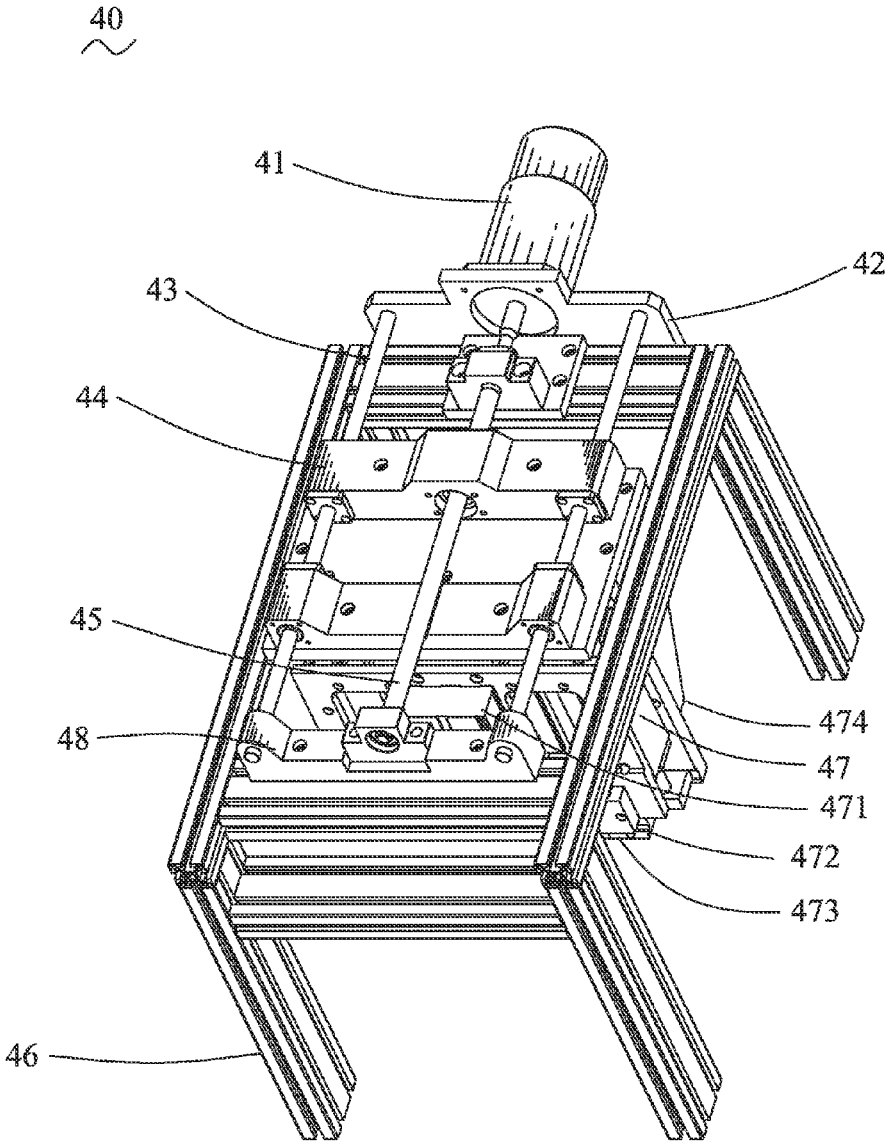
FIG. 4 is a perspective view of an automatic tearing film module of the automatic circle forming apparatus of FIG. 1.

Referring to FIG. 1 and FIG. 4, the automatic tearing film module 40 is mounted on the first base plate 10, and is located above the transmitting module 20 and the automatic separating module 30. The automatic tearing film module 40 includes a fastening frame 46 having two ends, a displacement servo 41, a servo fastening plate 42, a pair of second guiding rods 43, a second sliding block 44, a screw rod 45, a clamping claw mechanism 47 and a locating block 48. The servo fastening plate 42 is mounted to one end of the fastening frame 46. The displacement servo 41 is disposed to an outer side of the servo fastening plate 42. The locating block 48 is mounted to the other end of the fastening frame 46. The two second guiding rods 43 pass through two opposite sides of the second sliding block 44. The screw rod 45 passes through the second sliding block 44 and is connected between the displacement servo 41 and the locating block 48. The two second guiding rods 43 together with the second sliding block 44 are located between the servo fastening plate 42 and the locating block 48. The clamping claw mechanism 47 is mounted under the second sliding block 44. The second sliding block 47 includes a clamping claw shelf 474, a lower clamping claw 472, an upper clamping claw 473 and a clamping material cylinder 471 which are disposed to the clamping claw shelf 474. The clamping material cylinder 471 of the clamping claw mechanism 47 drives the upper clamping claw 473 of the clamping claw mechanism 47 to engage with the lower clamping claw 472 of the clamping claw mechanism 47 for clamping protecting films (not shown) adhered to glue portions of the OPP plastic films. The clamping claw mechanism 47 clamps the protecting films adhered to the glue portions of the OPP plastic films to move sideward under a drive of the displacement servo 41 for tearing up the protecting films.

Figure 5:
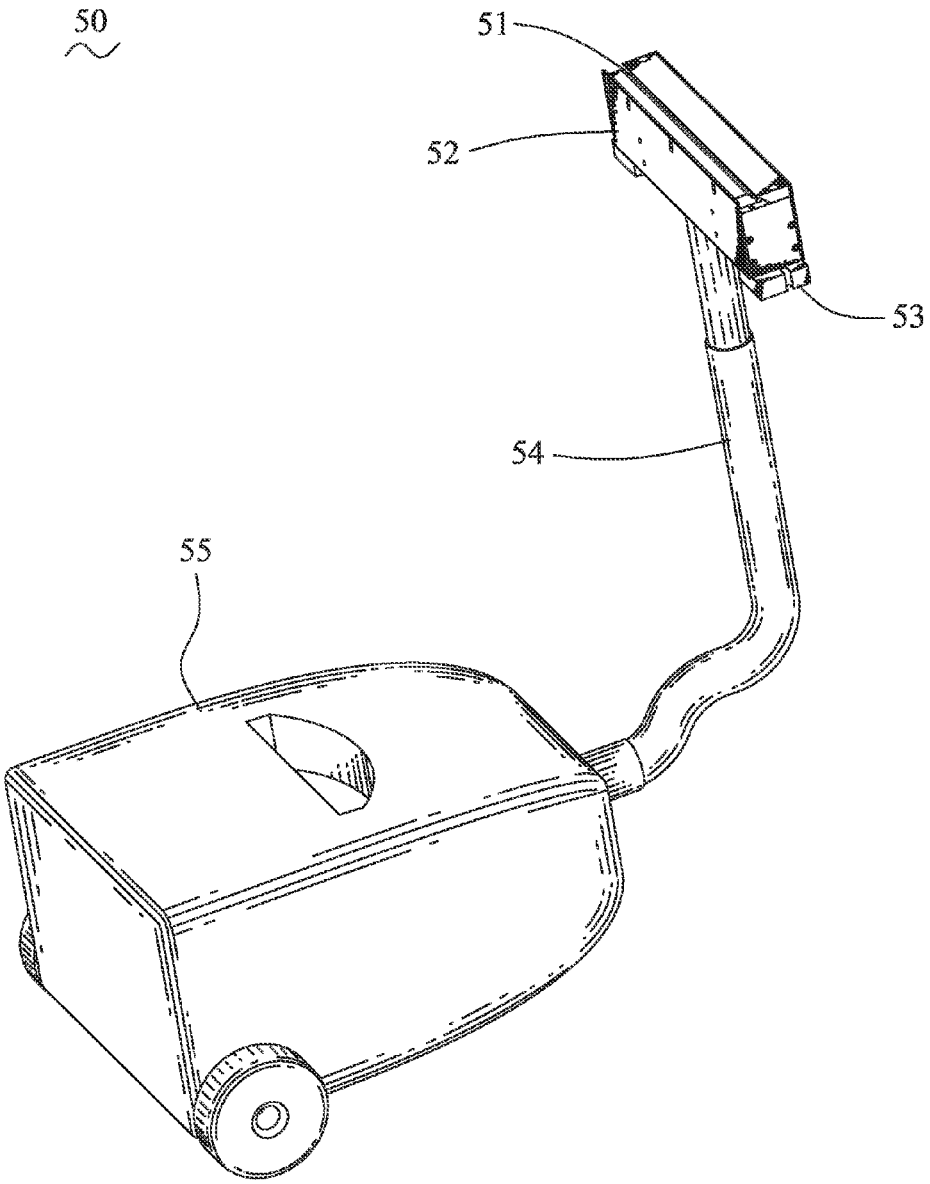
FIG. 5 is a perspective view of a sucking waste mechanism of the automatic circle forming apparatus of FIG. 1.

Referring to FIG. 5, the sucking waste mechanism 50 is mounted on the first base plate 10 and is adjacent to the automatic separating module 30. The sucking waste mechanism 50 is located under the automatic tearing film module 40. The sucking waste mechanism 50 includes a sucking frame 52, two fastening plates 53, a flexible pipe 54 and a cleaner 55. A top of the sucking frame 52 defines a waste entrance 51. Two opposite ends of a bottom of the sucking frame 52 are mounted to the two fastening plates 53. The flexible pipe 54 is connected between a middle of the bottom of the sucking frame 52 and the cleaner 55. The cleaner 55 is utilized to generate a sucking force for sucking away wastes, namely, the protecting films at the waste entrance 51 through the flexible pipe 54.

Figure 6:
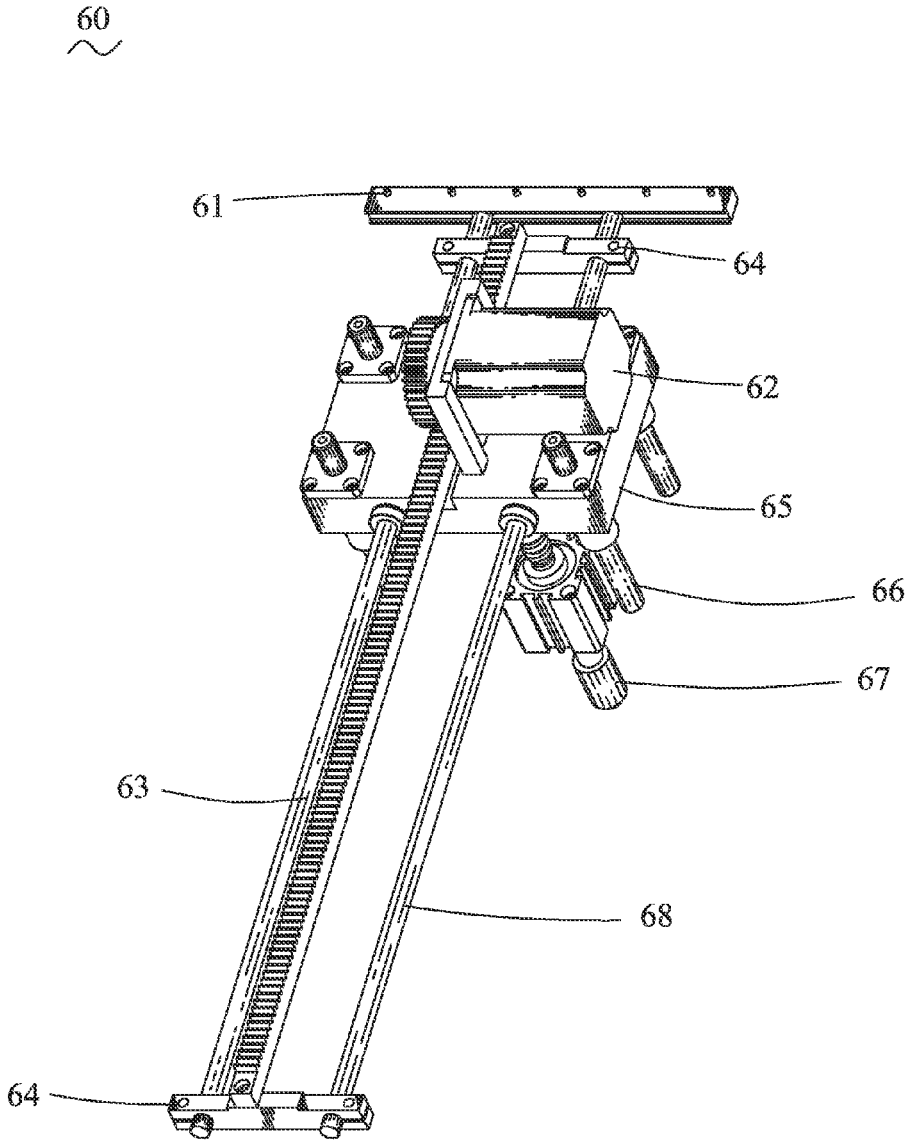
FIG. 6 is a perspective view of a displacement module of the automatic circle forming apparatus of FIG. 1.

Referring to FIG. 1 and FIG. 6, the displacement module 60 mounted on the other side of the first base plate 10 includes six sets of vacuum sucking discs 61, a displacement stepping motor 62, a supporting platform 65, four mounting pillars 66, an elevating cylinder 67, two guiding pillars 68, two fastening blocks 64 and a first spline 63. The displacement stepping motor 62 is mounted on the supporting platform 65. The mounting pillars 66 are mounted to the supporting platform 65. The elevating cylinder 67 is disposed under the supporting platform 65 and located among the four mounting pillars 66. The two guiding pillars 68 pass through the supporting platform 65. One fastening block 64 is connected with two free ends of the guiding pillars 68 located at one side of the supporting platform 65, and the other two free ends of the guiding pillars 68 located at the other side of the supporting platform 65 pass through the other fastening block 64 to locate the two guiding pillars 68 in the two opposite sides of the supporting platform 65. The first spline 63 is mounted between the two guiding pillars 68 and passes through the supporting platform 65. A first gear of the displacement stepping motor 62 is engaged with the first spline 63. A connecting block (not labeled) is connected with the other two free ends of the guiding pillars 68. The vacuum sucking discs 61 are mounted in the connecting block. In work, the elevating cylinder 67 descends and the vacuum sucking discs 61 suck the OPP plastic films, then the elevating cylinder 67 ascends and the displacement stepping motor 62 is activated to make the first gear of the displacement stepping motor 62 roll along the first spline 63 so as to bring along the vacuum sucking discs 61 to move back and forth for transmitting the OPP plastic films to the automatic forming module 70.

Figure 7:
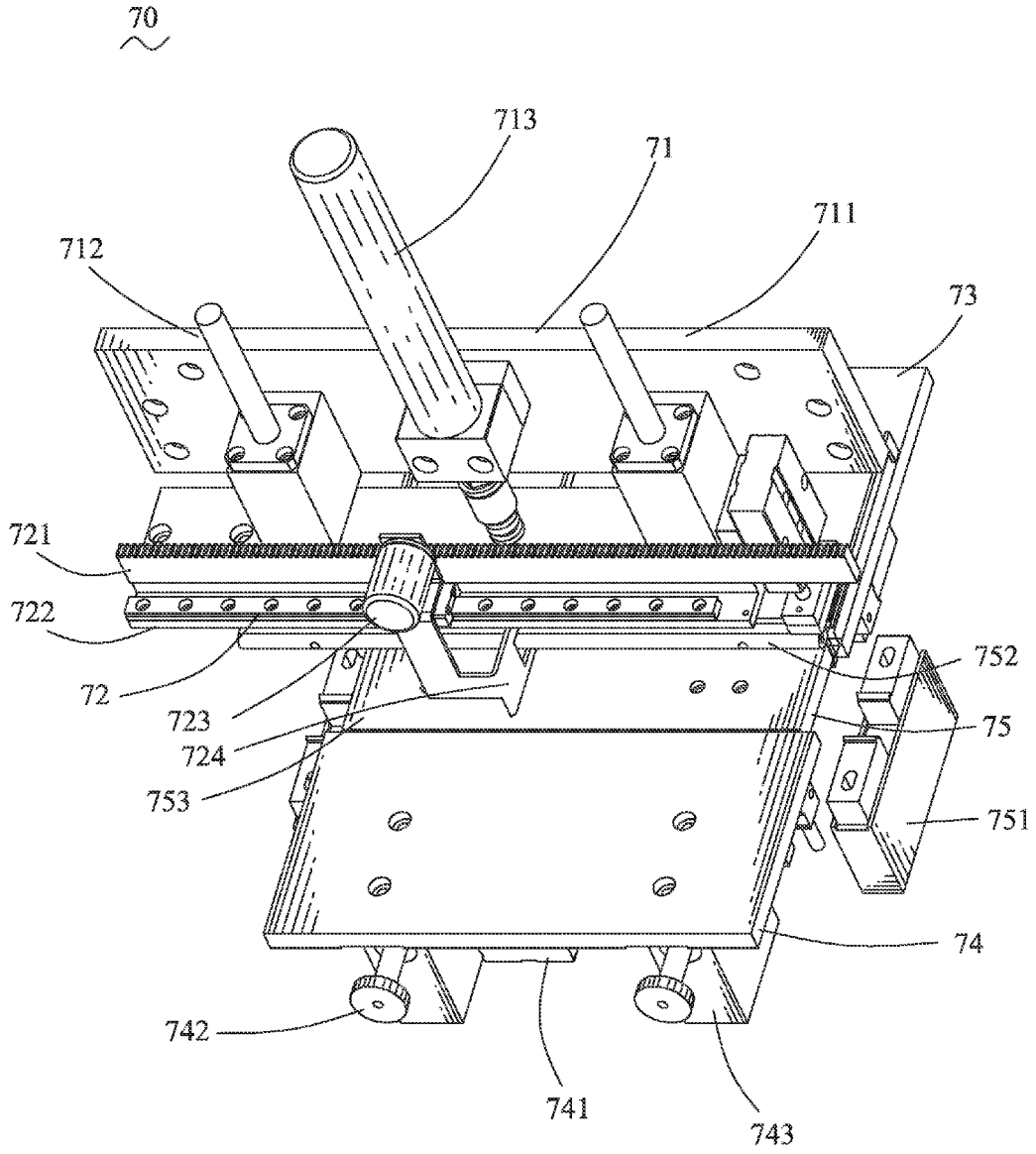
FIG. 7 is a perspective view of an automatic forming module of the automatic circle forming apparatus of FIG. 1.

Referring to FIG. 7, the automatic forming module 70 is mounted on the first base plate 10, and is located between the sucking waste mechanism 50 and the displacement module 60. The automatic forming module 70 includes a pressing mechanism 71, an automatic discharging mechanism 72, a left looping mechanism 73, a right looping mechanism 74 and a forming plate 75. The pressing mechanism 71 includes a pressing cylinder 713, a cylinder frame 711 and two pressing guiding pillars 712. The discharging mechanism 72 includes a discharging motor 723, a second spline 721, a linear sliding track 722 and a discharging plate 724. The right looping mechanism 74 includes a circling cylinder 741, two circling guiding pillars 742 and a second frame 743. The forming plate 75 includes a dimension modulating plate 751, an upper forming plate 752 and a lower forming plate 753. The cylinder frame 711, the pressing guiding pillars 712 and the pressing cylinder 713 are disposed on the upper forming plate 752 of the forming plate 75. The two pressing guiding pillars 712 are disposed to two opposite ends of one side of the cylinder frame 711, and the pressing cylinder 713 is disposed to the one side of the cylinder frame 711 and located between the two pressing guiding pillars 712. The pressing mechanism 71 is disposed to the upper forming plate 752 of the forming plate 75. The discharging mechanism 72 is disposed on the upper forming plate 752 of the forming plate 75 and connects with the pressing mechanism 71. The discharging mechanism 72 is located adjacent to the pressing cylinder 713 and the pressing guiding pillars 712. One end of the discharging motor 723 has a second gear (not shown) engaging with the second spline 721. The discharging motor 723 is slidably disposed on the linear sliding track 722. The discharging plate 724 is disposed on the forming plate 75 and connects with the discharging motor 723. The lower forming plate 753 connects with the upper forming plate 752. The dimension modulating plate 751 is located in front of the upper forming plate 752 and the lower forming plate 753. The left looping mechanism 73 and the right looping mechanism 74 are located at two opposite sides of the upper forming plate 752 and the lower forming plate 753. The circling cylinder 741 is located under the second frame 743, and the circling guiding pillars 742 pass through two opposite ends of the second frame 743. When the OPP plastic films arrive at the automatic forming module 70, the pressing cylinder 713 of the pressing mechanism 71 is activated to locate the OPP plastic films on the forming plate 75. Then circling cylinder 741 is activated to drive the left looping mechanism 73 and the right looping mechanism 74 for looping the OPP plastic films to form the OPP plastic circles. At last, the pressing cylinder 713 ascends and the discharging motor 723 is activated to drive the discharging plate 724 to further discharge the OPP plastic circles out of the automatic circle forming apparatus 100.

Figure 8:
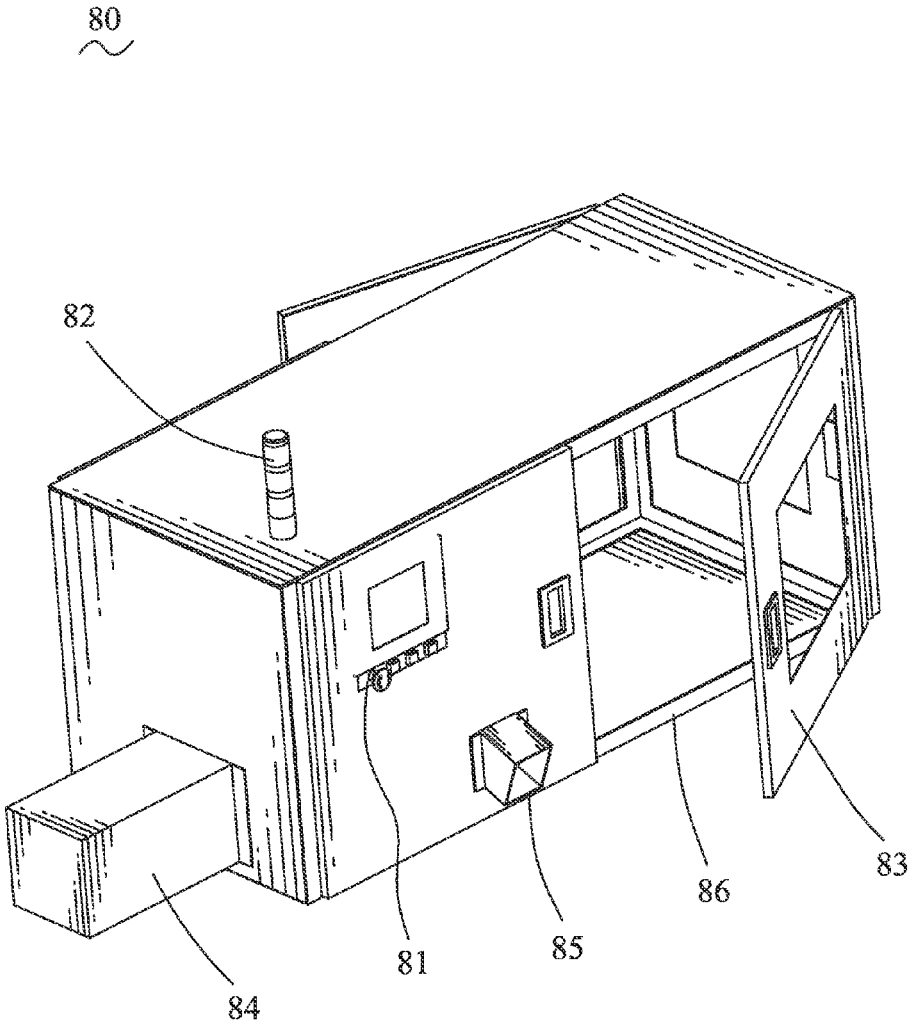
FIG. 8 is a perspective view of an upper equipment cabinet of the automatic circle forming apparatus of FIG. 1.

Referring to FIG. 8, the upper equipment cabinet 80 includes the man-machine control interface 81, an alarm indicator 82, a first cabinet door 83, a protecting mask 84 and a product exportation 85 and a box-shaped first main body 86. The man-machine control interface 81 is disposed to a top of one side of the front of the first main body 86 of the upper equipment cabinet 80 and the product exportation 85 is opened in a bottom of the one side of the front of the first main body 86 of the upper equipment cabinet 80. The first cabinet door 83 is disposed to the other side of the first main body 86 of the upper equipment cabinet 80. The alarm indicator 82 is mounted on top of the first main body 86 of the upper equipment cabinet 80. The protecting mask 84 is mounted to one end of the first main body 86 of the upper equipment cabinet 80. The man-machine control interface 81 is a control port to control an operation of the automatic circle forming apparatus 100. Parameters of the automatic circle forming apparatus 100 are set and modulated through the man-machine control interface 81. When any abnormal conditions are happened during the operation process, the alarm indicator 82 will flash red light to be as an alarm.

Figure 9:
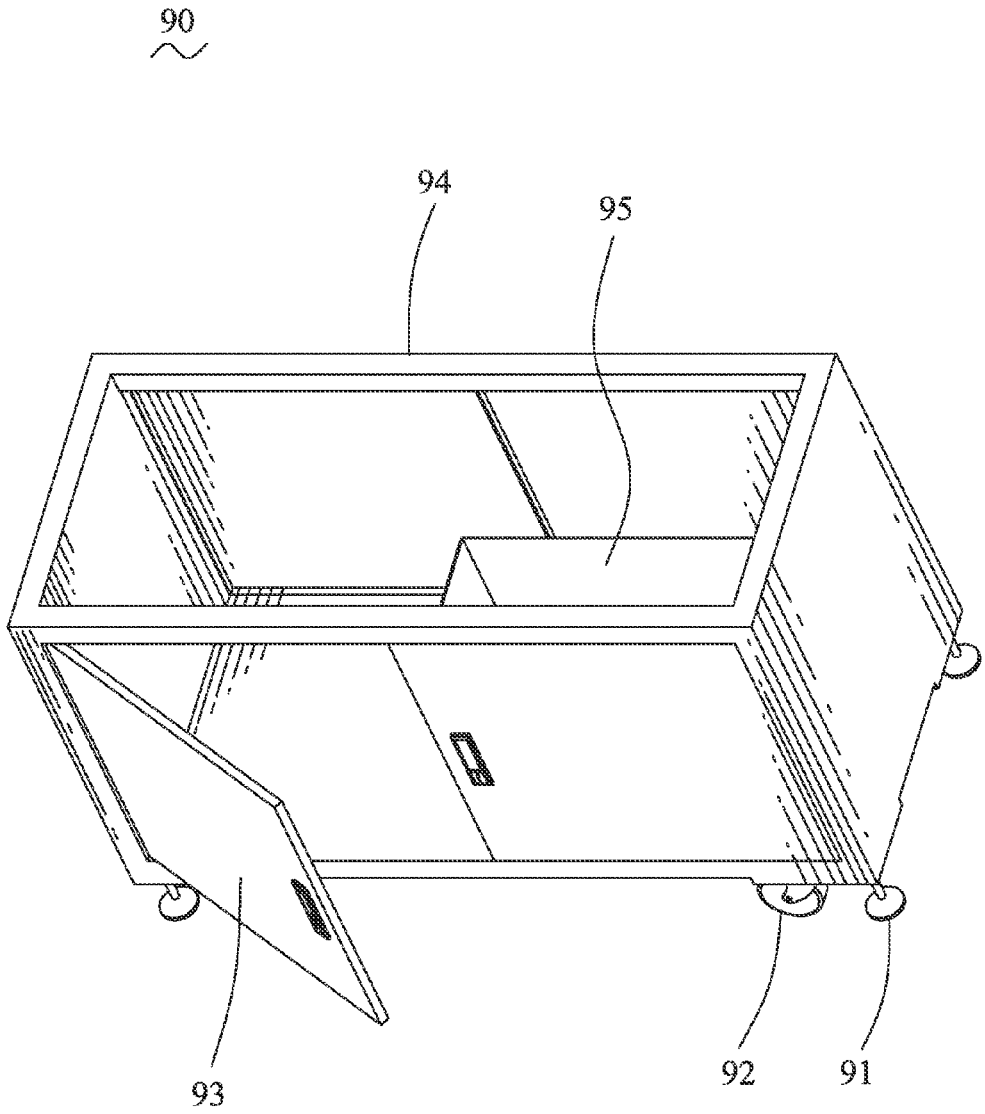
FIG. 9 is a perspective view of a lower equipment cabinet of the automatic circle forming apparatus of FIG. 1.

Referring to FIG. 9, the lower equipment cabinet 90 includes a box-shaped second main body 94, four shockproof foot frames 91, four universal wheels 92, a second cabinet door 93 and an electric cabinet 95. The four shockproof foot frames 91 are mounted to four corners of a bottom of the second main body 94 of the lower equipment cabinet 90 for locating the second main body 94 of the lower equipment cabinet 90. The four universal wheels 92 are mounted to a periphery of the bottom of the second main body 94 of the lower equipment cabinet 90 for making the second main body 94 of the lower equipment cabinet 90 movably. The second cabinet door 93 is disposed to one side of a front of the second main body 94 of the lower equipment cabinet 90. The electric cabinet 95 is disposed in the second main body 94 of the lower equipment cabinet 90, and the electric cabinet 95 is used for installing electric apparatuses therein and arranging wires of the automatic circle forming apparatus 100.

Referring to FIGS. 1-9, when the automatic circle forming apparatus 100 is operated, the release papers with the OPP plastic films are pushed to the transmitting entrance 211 of the transmitting module 20. Then the transmitting module 20 transmits the release papers with the OPP plastic films to the automatic separating module 30, at this moment, the clamping claws 34 of the automatic separating module 30 clamp the release papers to pull downward to separate the release papers from the OPP plastic films. The pressing cylinder 713 of the pressing mechanism 71 of the automatic forming module 70 is activated to locate the OPP plastic films on the forming plate 75. Then the automatic tearing film module 40 descends to make the clamping claw mechanism 47 clamp the protecting films adhered to the glue portions of the OPP plastic films to move sideward under the drive of the displacement servo 41 for tearing up the protecting films. Then, the automatic tearing film module 40 continues moving sideward to the waste entrance 51. In the meanwhile, the sucking waste mechanism 50 is activated to suck the protecting films into the cleaner 55, and then the automatic tearing film module 40 returns. The displacement module 60 moves sideward for sucking the OPP plastic films and further moves to the automatic forming module 70. Then circling cylinder 741 is activated to drive the left looping mechanism 73 and the right looping mechanism 74 for looping the OPP plastic films to form the OPP plastic circles. At last, the pressing cylinder 713 ascends and the discharging motor 723 is activated to drive the discharging plate 724 to discharge the OPP plastic circles out of the automatic circle forming apparatus 100. The whole circle forming operation of the OPP plastic circles only needs to push the release papers together with the OPP plastic films into the automatic circle forming apparatus 100, and then the automatic circle forming apparatus 100 automatically transmits the OPP plastic films, separates the release papers from the OPP plastic films, loops the OPP plastic films and discharges the OPP plastic circles. Six OPP plastic circles can be formed in one time so as to make the automatic circle forming apparatus 100 have a simple and fast circle forming operation. The circle forming operation described above can improve an operation efficiency, and replace a manual operation way of forming the OPP plastic circles related in prior art so as to need less operators to save a human cost. Furthermore, the automatic circle forming apparatus 100 has a fast operation speed and a stable quality to meet a mass production request.

As described above, the man-machine control interface 81 connects with and controls the transmitting module 20, the automatic separating module 30, the automatic tearing film module 40, the sucking waste mechanism 50, the displacement module 60 and the automatic forming module 70 for realizing a series of continuous operations of automatically transmitting the OPP plastic films, separating the release papers from the OPP plastic films, looping the OPP plastic films and discharging the OPP plastic circles so as to form a plurality of the OPP plastic circles in one time. Thus, the automatic circle forming apparatus 100 improves operation efficiency and decreases the operators to save the human cost. Furthermore, the automatic circle forming apparatus 100 has the fast operation speed and the stable quality to meet the mass production request.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An automatic circle forming apparatus adapted for automatically forming OPP (O-phenylphenol) plastic circles, comprising:

a lower equipment cabinet including an electric cabinet for installing electric apparatuses therein and arranging wires of the automatic circle forming apparatus;

a first base plate mounted on the lower equipment cabinet;

a transmitting module mounted on one side of the first base plate for locating release papers together with OPP plastic films therein;

an automatic separating module mounted on the first base plate and located under the transmitting module for separating the release papers from the OPP plastic films;

an automatic tearing film module mounted on the first base plate, and located above the transmitting module and the automatic separating module for tearing up protecting films adhered to glue portions of the OPP plastic films;

a sucking waste mechanism mounted on the first base plate and adjacent to the automatic separating module, the sucking waste mechanism being located under the automatic tearing film module for sucking away the protecting films;

a displacement module mounted on the other side of the first base plate for transmitting the OPP plastic films to an automatic forming module;

the automatic forming module mounted on the first base plate, and located between the sucking waste mechanism and the displacement module for looping the OPP plastic films to form the OPP plastic circles and further discharging the OPP plastic circles out of the automatic circle forming apparatus; and an upper equipment cabinet positioned on the first base plate for installing the transmitting module, the automatic separating module, the automatic tearing film module, the sucking waste mechanism, the displacement module and the automatic forming module therein, the upper equipment cabinet being equipped with a man-machine control interface;

wherein the man-machine control interface connects with and controls the transmitting module, the automatic separating module, the automatic tearing film module, the sucking waste mechanism, the displacement module and the automatic forming module for automatically forming the OPP plastic circles.

2. The automatic circle forming apparatus as claimed in claim 1, wherein the transmitting module includes a transmitting platform, a central transmitting module and a pressing material module, one side of the transmitting module is connected with one side of the transmitting platform, the pressing material module is disposed to the other side of the transmitting module.

3. The automatic circle forming apparatus as claimed in claim 2, wherein the transmitting module includes a transmitting motor, two pairs of transmitting rollers and two roller supporting frames, the two roller supporting frames are located in two opposite sides of the transmitting module, the two pairs of the transmitting rollers are mounted between the two roller supporting frames, the transmitting motor is mounted to one of the roller supporting frames to connect with the transmitting rollers for driving the transmitting rollers to bring along the release papers together with the OPP plastic films into the transmitting module.

4. The automatic circle forming apparatus as claimed in claim 2, wherein the pressing material module includes a first supporting frame, a pressing plate and a pressing cylinder, the pressing plate is mounted on the first supporting frame and the pressing cylinder is mounted on the pressing plate, the pressing cylinder pushes sideward to drive the release papers together with the OPP plastic films to be located in the pressing material module of the transmitting module.

5. The automatic circle forming apparatus as claimed in claim 1, wherein the automatic separating module includes a second base plate, two first guiding rods, a first sliding block, a cylinder fastening shelf and a pulling paper cylinder, two opposite ends of the second base plate extend in parallel towards a same direction to form two supporting plates, the two guiding rods pass through two opposite sides of the first sliding block, the two guiding rods together with the first sliding block are mounted between the two supporting plates, a top of the first sliding block defines a plurality of clamping claws for clamping the release papers, the cylinder fastening shelf is mounted to the second base plate and located between the two first guiding rods, the pulling paper cylinder is connected with a bottom of the cylinder fastening shelf, the clamping claws clamp the release papers to pull downward under a drive of the pulling paper cylinder for separating the release papers from the OPP plastic films.

6. The automatic circle forming apparatus as claimed in claim 1, wherein the automatic tearing film module includes a fastening frame having two ends, a displacement servo, a servo fastening plate, a pair of second guiding rods, a second sliding block, a screw rod, a clamping claw mechanism and a locating block, the servo fastening plate is mounted to one end of the fastening frame, the displacement servo is disposed to an outer side of the servo fastening plate, the locating block is mounted to the other end of the fastening frame, the two second guiding rods pass through two opposite sides of the second sliding block, the screw rod passes through the second sliding block and is connected between the displacement servo and the locating block, the two second guiding rods together with the second sliding block are located between the servo fastening plate and the locating block, the clamping claw mechanism is mounted under the second sliding block, the clamping claw mechanism clamps the protecting films to move sideward under a drive of the displacement servo for tearing up the protecting films.

7. The automatic circle forming apparatus as claimed in claim 6, wherein the second sliding block includes a clamping claw shelf, a lower clamping claw, an upper clamping claw and a clamping material cylinder which are disposed to the clamping claw shelf, the clamping material cylinder drives the upper clamping claw to engage with the lower clamping claw for clamping the protecting films.

8. The automatic circle forming apparatus as claimed in claim 1, wherein the sucking waste mechanism includes a sucking frame, two fastening plates, a flexible pipe and a cleaner, a top of the sucking frame defines a waste entrance, two opposite ends of a bottom of the sucking frame are mounted to the two fastening plates, the flexible pipe is connected between the sucking frame and the cleaner, the cleaner is utilized to generate a sucking force for sucking away the protecting films at the waste entrance through the flexible pipe.

9. The automatic circle forming apparatus as claimed in claim 1, wherein the displacement module includes a plurality of vacuum sucking discs, two fastening blocks, a supporting platform, a displacement stepping motor, four mounting pillars, an elevating cylinder, two guiding pillars and a first spline which are disposed to the supporting platform, one fastening block is connected with two free ends of the guiding pillars, and the other two free ends of the guiding pillars pass through the other fastening block to locate the two guiding pillars in the two opposite sides of the supporting platform, a first gear of the displacement stepping motor is engaged with the first spline, a connecting block with the vacuum sucking discs mounted therein is connected with the other two free ends of the guiding pillars, the elevating cylinder descends and the vacuum sucking discs suck the OPP plastic films, then the elevating cylinder ascends and the displacement stepping motor is activated to make the first gear of the displacement stepping motor roll along the first spline so as to bring along the vacuum sucking discs to move back and forth for transmitting the OPP plastic films to the automatic forming module.

10. The automatic circle forming apparatus as claimed in claim 1, wherein the automatic forming module includes a forming plate, a pressing mechanism, an automatic discharging mechanism, a left looping mechanism, a right looping mechanism which are disposed to the forming plate, the discharging mechanism connecting with the pressing mechanism includes a discharging motor and a discharging plate connecting with the discharging motor, when the OPP plastic films arrive at the automatic forming module, a pressing cylinder of the pressing mechanism is activated to locate the OPP plastic films on the forming plate, then a circling cylinder of the right looping mechanism is activated to drive the left looping mechanism and the right looping mechanism for looping the OPP plastic films to form the OPP plastic circles, at last, the pressing cylinder ascends and the discharging motor is activated to drive the discharging plate to discharge the OPP plastic circles out of the automatic circle forming apparatus.

* * * * *